US005727490A

United States Patent [19]

McGaver

[11] Patent Number: 5,727,490

[45] Date of Patent: Mar. 17, 1998

[54] METHOD AND SYSTEM FOR MANUFACTURING ART PIECES HAVING A STITCHED ORNAMENTAL DESIGN

[76] Inventor: Frederick McGaver, 405 Wilmont Dr., Waukesha, Wis. 53186

[21] Appl. No.: 583,404

[22] Filed: Jan. 5, 1996

[51] Int. Cl.[6] ..... D05C 5/02

[52] U.S. Cl. ..... 112/475.19; 112/102.5; 112/470.05; 40/124.12

[58] Field of Search ..... 112/475.19, 475.06, 112/475.22, 470.06, 470.05, 470.04, 102.5, 304, 439; 40/124.01, 124.09, 124.12, 124.191

[56] References Cited

U.S. PATENT DOCUMENTS

| | | | |
|---|---|---|---|
| 656,132 | 8/1900 | Buff . | |
| 2,394,980 | 2/1946 | Byck . | |
| 4,525,393 | 6/1985 | DiCostanzo . | |
| 4,564,406 | 1/1986 | Binks . | |
| 4,597,812 | 7/1986 | Hamilton . | |
| 4,807,807 | 2/1989 | Glick | 40/124.191 |
| 5,303,487 | 4/1994 | Olson | 40/124.12 |
| 5,537,939 | 7/1996 | Horton | 112/475.19 |

*Primary Examiner*—Peter Nerbun

*Attorney, Agent, or Firm*—Nilles & Nilles, S.C.

[57] ABSTRACT

A method of manufacturing a greeting card comprises the steps of generating an ornamental design on a computer, outputting a digital representation of the ornamental design, computer stitching the ornamental design on a sheet of fabric, folding a first sheet of card stock into a tri-fold configuration having first through third equal portions, cutting a window into the first portion, and bonding the first portion, the second portion, and the sheet of fabric together so as to form the greeting card. The computer stitching step includes the step of utilizing the digital representation with a computer-operated stitching machine. A similar method can be used to manufacture other types of display devices. A device for displaying an ornamental design comprises a first section of card stock, a second section of card stock, a sheet of fabric, and a sheet of web adhesive. The first section of card stock has a window cut therein. The sheet of fabric has the ornamental design computer stitched thereon and is disposed between the first and second sections of card stock. The sheet of web adhesive is disposed between the sheet of fabric and the second section of card stock and bonds the sheet of fabric to the first and second sections of card stock. The present invention advantageously provides an inexpensive system for manufacturing high quality decorative art pieces.

13 Claims, 4 Drawing Sheets

METHOD AND SYSTEM FOR MANUFACTURING ART PIECES HAVING A STITCHED ORNAMENTAL DESIGN

FIELD OF THE INVENTION

The present invention relates to a method and system for manufacturing art pieces, and specifically to a method and system for manufacturing art pieces having a stitched ornamental design.

DESCRIPTION OF RELATED ART

There is an ongoing desire for decorative art pieces which are of high quality and yet which are also inexpensive. Various processes, such as photographic processes and color printing, are known which can be used to place a two dimensional ornamental design on an art piece formed of photographic paper or card stock. These processes are commonly used to produce greeting cards and similar objects which display ornamental designs. The drawback to these processes is that, no matter how appealing the design, the final product is still untextured and two dimensional.

Other process are known which can place a textured, three dimensional design on a decorative art piece. For example, hand embroidery is known for placing ornamental designs on a sheet of fabric. It is then possible to mount the sheet of fabric in a manner suitable for display. This procedure produces a textured, three dimensional final product which has the "look and feel" of a high quality art piece.

However, when trying to produce these high quality art pieces on a large scale for retail sale, several problems are encountered. First, the amount of manual labor in the above-described process is unacceptably high. The hand embroidery process is time consuming and prohibitively expensive. As well, the process of manually mounting the sheet of fabric in a manner suitable for display is also time consuming and prohibitively expensive. In this regard, great difficulty has been encountered trying to automate the mounting process. Specifically, mounting the sheet of fabric on the sheet of card stock quickly and automatically, without burning, discoloring, or deforming the card stock, has proven to be elusively difficult. As a result of these difficulties, it has not been considered commercially practical to manufacture textured, three dimensional art pieces on a large scale.

Hence, there is a need for art pieces having a stitched ornamental design which can be manufactured cost effectively, and for a method and system which can cost effectively manufacture such art pieces.

SUMMARY OF THE INVENTION

A method of manufacturing an art piece having a stitched ornamental design is presented. The method according to the present invention comprises the steps of generating an ornamental design on a computer, outputting a digital representation of the ornamental design, computer stitching the ornamental design on a sheet of fabric, folding a first sheet of card stock into a tri-fold configuration having first through third equal portions, cutting a window into the first portion, and bonding the first portion, the second portion, and the sheet of fabric together so as to form a greeting card. The computer stitching step includes the step of utilizing the digital representation with a computer-operated stitching machine. A similar method can be used to manufacture other types of display devices. Advantageously, the amount of manual labor required to place the ornamental design onto the sheet of fabric is reduced, because the ornamental design is computer stitched onto the fabric (i.e., rather than hand embroidered).

Also presented is an art piece comprising a first section of card stock, a second section of card stock, a sheet of fabric, and a sheet of web adhesive. The first section of card stock has a window cut therein. The sheet of fabric has the ornamental design computer stitched thereon and is disposed between the first and second sections of card stock. The sheet of web adhesive is disposed between the sheet of fabric and the second section of card stock. Advantageously, the sheet of web adhesive may be applied so as to bond the sheet of fabric to the first and second sections of card stock without discoloring, burning, or deforming the card stock. Also, the sheet of web adhesive is much easier to handle than liquid adhesives, and lends itself to large scale production of art pieces.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 1A:
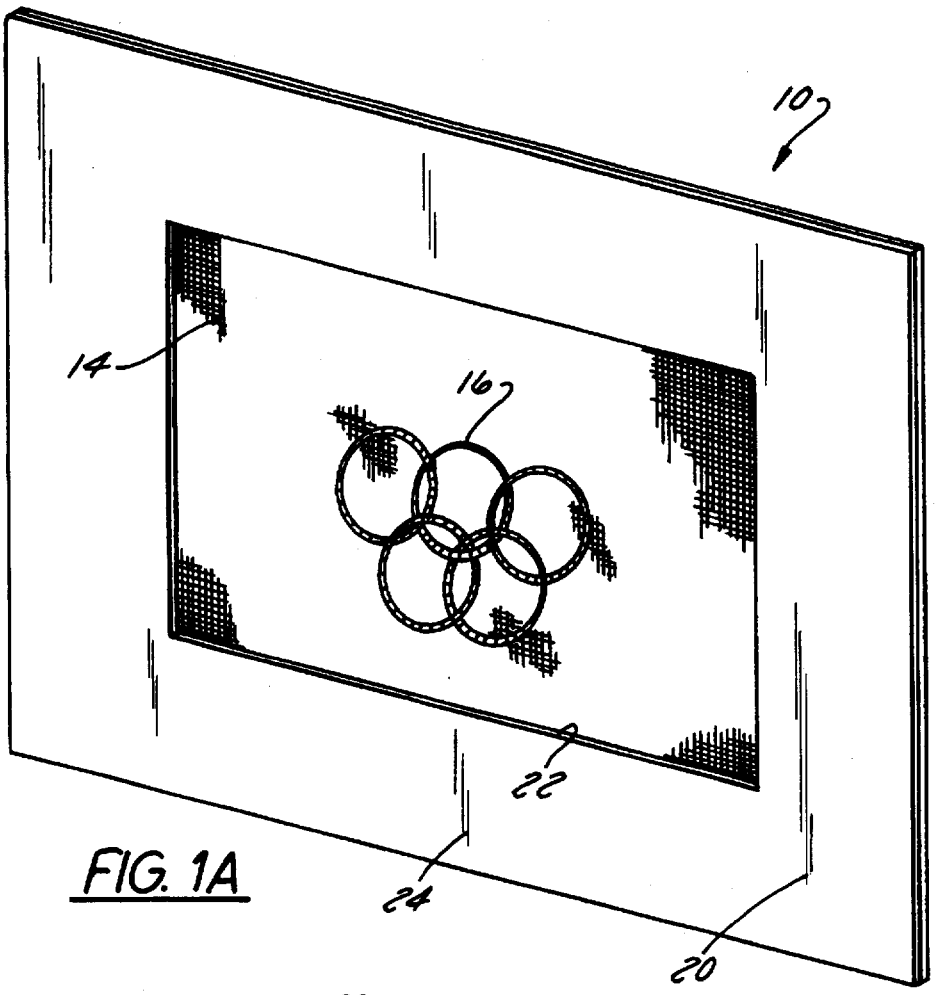
FIGS. 1A and 1B are a first preferred art piece in accordance with the present invention.
Figure 1B:
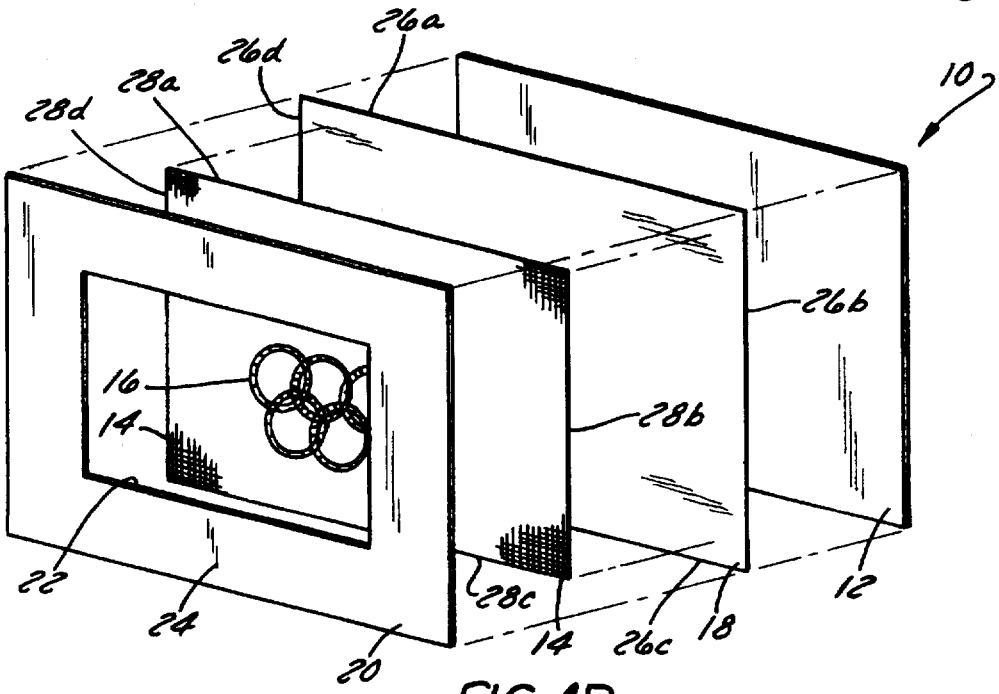

1. Detailed Description of Preferred Art Pieces Having a Stitched Ornamental Design A first preferred art piece 10 is illustrated in FIG. 1. The art piece 10 comprises a first sheet of card stock 12, a sheet of fabric 14 having an ornamental design 16 stitched thereon, a sheet of web adhesive 18, and a second sheet of card stock 20.

Specifically, the sheet of fabric 14 is disposed beneath the second sheet of card stock 20, the sheet of web adhesive 18 is disposed beneath the sheet of fabric 14, and the first sheet of card stock 12 is disposed beneath the sheet of web adhesive 18. The ornamental design 16 is placed on the side of the sheet of fabric 14 which is adjacent the second sheet of card stock 20. The second sheet of card stock 20 has a window 22 cut therein, thereby permitting the design 16 to remain viewable through the window 22, with the second sheet of card stock 20 providing a decorative border 24 around the ornamental design 16.

The first sheet of card stock 12, the sheet of fabric 14 and the second sheet of card stock 20 are bonded together by the sheet of web adhesive 18. Preferably, edges 26*a*–26*d* of the sheet web adhesive 18 are folded over edges 28*a*–28*d*, respectively, of the sheet of fabric 14, so that there is adhesive on both sides of the sheet of fabric 14. As a result, the fabric 14 is bonded to both the first sheet of card stock 12 and the second sheet of card stock 20. Of course, there are other ways of ensuring that adhesive is on both sides of the sheet of fabric 14. For example, a second sheet of web adhesive having a window cut therein (not illustrated) could be placed in between the sheet of fabric 14 and the second sheet of card stock 20. In either case, however, the sheet of web adhesive 18, after having undergone a bonding process discussed below, bonds the sheet of fabric 14 to both of the sheets of card stock 12 and 20.

Figure 2A:
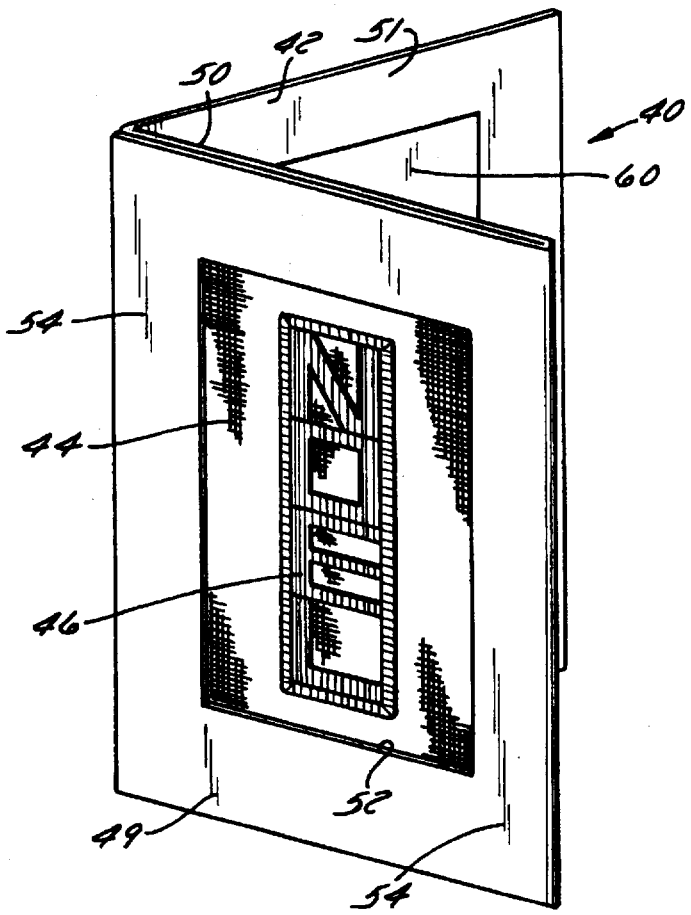
FIGS. 2A, 2B and 2C are a second preferred art piece in the form of a greeting card in accordance with the present invention.
Figure 2C:
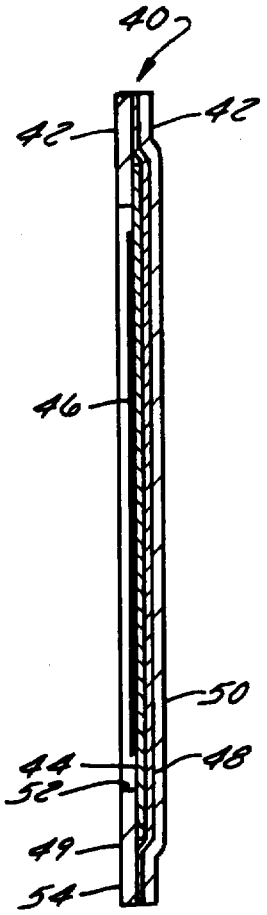
Figure 2B:
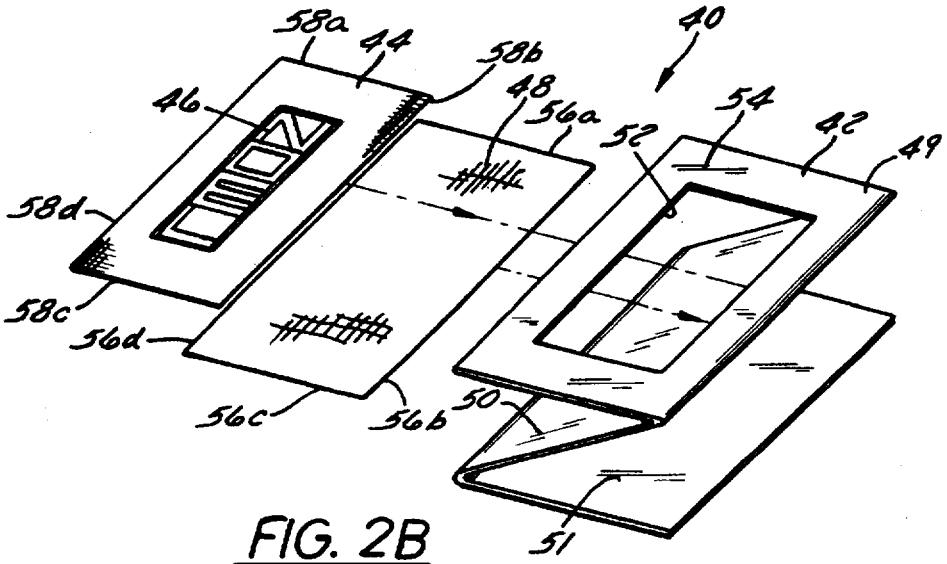

A second preferred art piece 40 in the form of a greeting card according to the present invention is illustrated in FIG. 2. The greeting card 40 comprises a sheet of card stock 42, a sheet of fabric 44 having an ornamental design 46 computer stitched thereon, and a sheet of web adhesive 48.

In the preferred embodiment, the sheet of card stock 42 is folded into a tri-fold configuration having first, second, and third folded equal portions 49, 50 and 51, respectively. Further, the sheet of fabric 44 is disposed beneath the first folded portion 49, the sheet of web adhesive 48 is disposed beneath the sheet of fabric 44, the second folded portion 50 is disposed beneath the sheet of web adhesive 48, and the third folded portion 51 is disposed beneath the second folded portion 50.

The ornamental design 46 is placed on the side of the sheet of fabric 44 which is adjacent the first folded portion 49. The first folded portion 49 has a window 52 cut therein, thereby permitting the design 46 to remain viewable through the window 52 with the first folded portion 49 providing a decorative border 54 around the design 46.

The first folded portion 49, the sheet of fabric 44 and the second folded portion 50 are bonded together by the sheet of web adhesive 48. Preferably, edges 56*a*–56*d* of the sheet web adhesive 48 are folded over edges 58*a*–58*d*, respectively, of the sheet of fabric 44, so that there is adhesive on both sides of the sheet of fabric 44. As a result, the fabric 44 is bonded to both the first folded portion 49 and the second folded portion 50. Again, of course, there are other ways of ensuring that adhesive is on both sides of the sheet of fabric 44. For example, a second sheet of web adhesive having a window cut therein (not illustrated) could be placed in between the sheet of fabric 44 and the first folded portion 49. In either case, however, the sheet of web adhesive 48, after having undergone a bonding process discussed below, bonds the sheet of fabric 44 to the both folded portions 49 and 50.

Preferably, a light colored paper insert 60 with dark colored printing thereon is glued to the inner fold between the second and third portions 50 and 51 of the sheet of card stock 42. Advantageously, the paper insert 60 permits the use of dark printing in conjunction with dark colored card stock (i.e., since, without a light colored insert, it would be difficult to read dark printing on dark colored card stock). The paper insert 60 also adds to the overall aesthetic appearance of the greeting card 40.

The tri-fold configuration discussed above represents an especially cost effective configuration for manufacturing the greeting card 40, because it uses no more adhesive and paper than is necessary. To understand the efficiency of the tri-fold configuration, it is helpful to consider potential alternative configurations. For example, a quad-fold configuration could be used wherein the sheet of card stock 42 is folded into four equal portions. In this configuration, however, it is necessary to use two separate sheets of adhesive to bond two sets of equal folded portions. Assuming the sheet of fabric 14 is inserted between a first set of folded portions, then the remaining two folded portions are simply glued together. Consequently, the remaining two folded portions represent wasted paper and wasted adhesive (i.e., since the function they serve could be served by a single folded portion, which would not require adhesive). Further, the fact that the remaining two folded portions must be glued together adds extra complexity to the manufacturing process. In contrast, the tri-fold configuration does not waste paper and adhesive, and is therefore less expensive to manufacture.

Assuming that the tri-fold configuration is used, embodiments other than that illustrated are also possible. For example, the first folded portion 49 could be any one of the three (i.e., the left, middle, or right) folded portions. Depending on which portion is the first folded 49, different folding arrangements can be devised to ensure that the ornamental design 46 remains visible through the window 52.

Advantageously, the art pieces 10 and 40 have the look and feel of high quality art pieces. The computer stitching adds texture to the art pieces 10 and 40 not present with photographic and color printing processes. In the case of the art piece 40, it has been found that the art piece 40 serves not only as a greeting card, but may also serve as a gift since it is of high quality and may easily be mounted. Methods and systems for manufacturing the art pieces 10 and 40 are now described.

Figure 3:
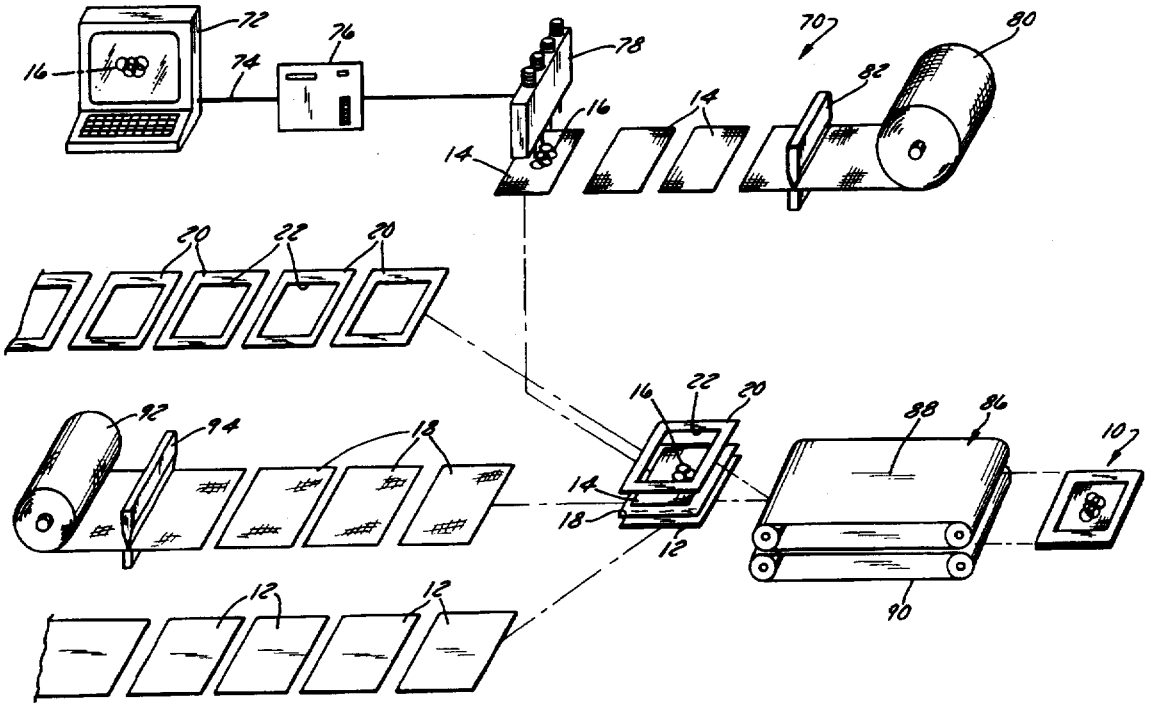
FIG. 3 is a system for manufacturing the art piece of FIG. 1 in accordance with the present invention.

2. Detailed Description of Preferred Methods and Systems for Manufacturing Art Pieces Having a Stitched Ornamental Design FIG. 3 illustrates a system 70 which can be used to manufacture the art piece 10. The system 70 comprises a first computer 72, a second computer 76, a stitching machine 78, a cutting device 82, and a bonding device 86.

The first computer 72 is equipped with software which may be used by an operator to generate the ornamental design 16. After the ornamental design 16 has been completed, the software outputs a digital representation of the ornamental design 16. The digital representation can be in a variety of formats. For example, the digital representation could be in the form of a computer program which, when executed by the second computer 76, causes the stitching machine 78 to stitch the ornamental design 16. Alternatively, the digital representation could be in the form of a data structure which is incorporated into a more generic computer program stored in the second computer 76.

The digital representation is transmitted via a digital link 74 to the second computer 76. The digital link can also take a variety of forms. For example, the first computer 72 and the second computer 76 could be directly linked via a network. Alternatively, the digital link could comprise a magnetic tape or disk which stores the digital representation and which may be read by the second computer 76.

The second computer 76 is coupled to and controls a stitching device 78. The stitching device 78 and the second computer 76 cooperate so as to stitch designs into fabric based on information stored in the second computer 76. Hence, once the digital representation of the design 16 is received by the second computer 76, it is possible for the second computer 76 and the stitching machine 78 to transfer that design to fabric. While the stitched design is generally the same as the design generated on the computer, it is preferable to test the stitching device to ensure such correspondence before large scale production is initiated.

After testing for correspondence, the stitching device may begin rapidly turning out sheets of fabric having the ornamental design 16 computer stitched thereon. Specifically, a cutting device 82 is used to cut individual sheets of fabric, including the sheet of fabric 14, from a supply of fabric 80. The sheet of fabric 14 is then fed to the stitching device 78. Based on the digital representation of the ornamental design 16 received from the first computer 72, the second computer 76 controls the stitching device 78 so that the ornamental design 16 is stitched into the sheet of fabric 14.

After the ornamental design 16 has been computer stitched into the sheet of fabric 14, it may be desirable to trim the sheet of fabric 14. Due to the nature of the stitching process, them will be extraneous threads which undesirably connect various portions of the stitched ornamental design 16. Consequently, it is desirable to remove these extraneous threads.

After the design is trimmed, the sheet of fabric 14 is combined with the first and second sheets of card stock 12 and 20. Specifically, the sheet of fabric 14 is disposed between the first and second sheets of card stock 12 and 20. Further, the sheet of web adhesive is disposed between the first sheet of card stock 12 and the sheet of fabric 14. The edges of the sheet of web adhesive are also folded over the edges of the sheet of fabric, as discussed above. The combination of the first sheet of card stock 12, the sheet of web adhesive 18, the sheet of fabric 14, and the second sheet of card stock 20 is then inserted into the bonding device 86. The bonding device preferably comprises a pair of opposing conveyor belts 88 and 90 which pass the combination through the bonding device 86.

Advantageously, the bonding device 86 quickly bonds the components of the art piece 10 without burning, discoloring or deforming the first and second sheets of card stock 12 and 20. A number of factors contribute to the success of the bonding device 86.

First, the temperature of the bonding device 86 is carefully controlled so as to be not to cool and yet not too hot, either. If the process temperature is too cool, the web adhesive does not melt properly, and improper bonding occurs between the first sheet of card stock 12, the sheet of fabric 14, and the second sheet of card stock 20. If the process temperature is too hot, then burning, discoloration and deformation of the sheets of card stock 12 and 20 can occur. A temperature more than 365° F. has been found to be too hot. Preferably, the process temperature is in the range of 290° to 320° F., and more preferably in the range of 300° to 310° F.

Additionally, the pressure which the belts 88 and 90 apply to the first sheet of card stock 12, the sheet of fabric 14, and the second sheet of card stock 20 is also carefully controlled. As is known, pressure and temperature are closely related, so that the effects of improper pressure are generally similar to the effects of improper temperature. Specifically, if the applied pressure is too low, then the web adhesive does not melt properly and improper bonding occurs between the first sheet of card stock 12, the sheet of fabric 14, and the second sheet of card stock 20. If the applied pressure is too high, then burning, discoloration, and deformation of the sheets of card stock 12 and 20 are more likely to occur. Preferably, the pressure is kept in the range of about 240 to 260 lbs per square inch, and more preferably at about 250 lbs per square inch.

Finally, the choice of adhesive is also important. A variety of adhesives exist which could be used to bond the first sheet of card stock 12, the sheet of fabric 14, and the second sheet of card stock 20. For example, a liquid adhesive could be used. However, in the present situation, liquid adhesives are inferior to web adhesives. Liquid adhesive are more difficult to handle cleanly, and can cause the paper to shrink and consequently warp. The ease with which web adhesives may be handled makes web adhesives especially suitable for large scale production of art pieces, because it simplifies the production process. This is especially true where, as here, the adhesive is used in conjunction with fabric which is particularly susceptible to degradation due to improperly applied adhesive.

Assuming that one has chosen to use a web adhesive, it is also important to select the proper web adhesive. The web adhesive needs to be able to melt at a temperature which does not bum the card stock. Hence, in this case, the web adhesive must melt at temperature which is less than 365° F., and preferably less than 310° F. Additionally, the quantity of web adhesive in the sheet of adhesive is also important. If there is too much adhesive per adhesive sheet, then the adhesive starts to soak through the fabric. If there is too little adhesive per adhesive sheet, improper bonding results. A polyester web adhesive having the following characteristics has been found to be ideal: minimum heat activation temperature of about 280° F. and a density of about 0.3 lbs per gallon.

The speed of the belts 88 and 90 must be controlled so as to keep the art piece 10 in the conveyor 86 for a sufficient duration. This is because heat must be applied to the web adhesive long enough to cause the web adhesive to activate. It has been found that applying heat for a duration of about seven seconds is adequate for the web adhesive in the art piece 10 to activate.

After the art piece 10 passes through the conveyor 86, the web adhesive cools down and solidifies. When the web adhesive 18 solidifies, it bonds the first sheet of card stock 12 to both the sheet of fabric 14 and the second sheet of card stock 20.

Figure 4:
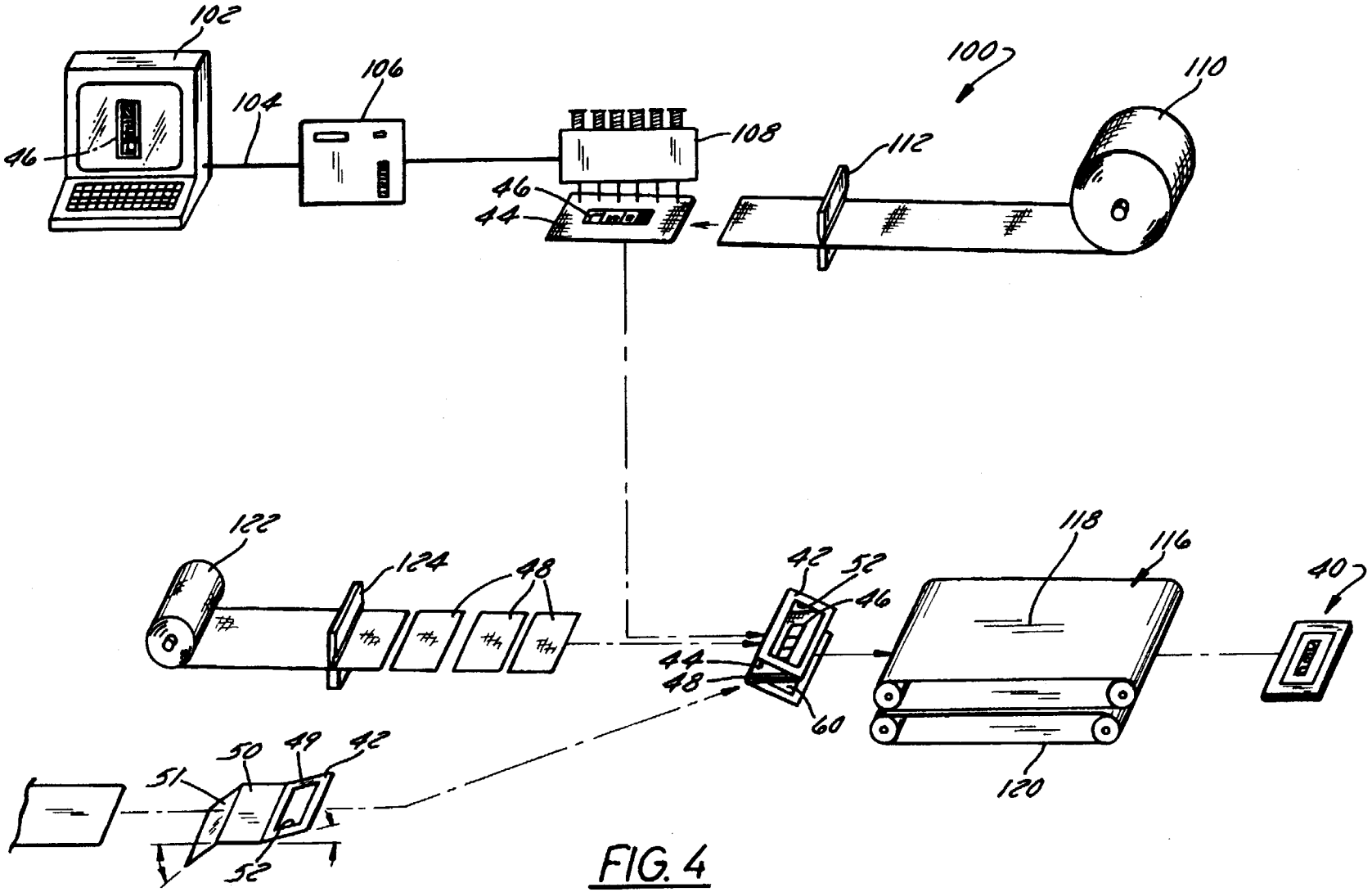
FIG. 4 is a system for manufacturing the greeting card art piece of FIG. 2 in accordance with the present invention.

FIG. 4 is a system 100 which can be used to manufacture the greeting card 40 in accordance with the present invention. The system 100 is generally very similar to the system 70, and is therefore only summarized below.

Specifically, the first computer 102 is equipped with software which may be used by an operator to generate the ornamental design 46. After the ornamental design 46 has been completed, the software outputs a digital representation of the ornamental design 46. The digital representation is then transmitted via a digital link 104 to the second computer 106. The second computer 106 is coupled to and controls a stitching device 108. The stitching device 108 and the second computer 106 cooperate so as to stitch designs into fabric based on information stored in the second computer 106. Hence, once the digital representation of the design 46 is received by the second computer 106, it is possible for the second computer 106 and the stitching machine 108 to transfer that design to fabric.

The stitching device rapidly turns out sheets of fabric having the ornamental design 46 computer stitched thereon. Specifically, a cutting device 112 is used to cut individual sheets of fabric, including the sheet of fabric 44, from a supply of fabric 110. The sheet of fabric 44 is then fed to the stitching device 108. Based on the digital representation of the ornamental design 46 received from the first computer 102, the second computer 106 controls the stitching device 108 so that the ornamental design 46 is stitched into the sheet of fabric 44.

Eventually, the sheet of fabric 44 is combined with the sheet of card stock 42. The sheet of card stock has been folded into first, second, and third equal portions 49–51 by folding device (not illustrated) which is adapted for serving this purpose. The sheet of fabric 44 is disposed between the first and second folded portions 49 and 50 of the sheet of card stock 42. Further, the sheet of web adhesive is disposed between the second folded portion 50 and the sheet of fabric 44. The edges of the sheet of web adhesive are also folded over the edges of the sheet of fabric, as discussed above. The combination of the sheet of card stock 42, the sheet of web adhesive 48, and the sheet of fabric 44 is then inserted into the bonding device 116.

Advantageously, the bonding device 116 quickly bonds the components of the art piece 40 without burning, discoloring, or deforming the sheet of card stock 42. The same factors which contribute to the success of the bonding device 86 contribute to the success of the bonding device 116. As discussed above, these factors include (1) the careful control of the bonding process temperature; (2) the careful control of the bonding process pressure; and (3) the selection of the proper adhesive. In this case, the greeting card 40 takes about thirty seconds to pass through the bonding device 116.

After the art piece 40 passes through the bonding device 116, the web adhesive cools down and solidifies. When the web adhesive 48 solidifies, it bonds the sheet of card stock 42 to the sheet of fabric 44.

Finally, the paper insert 56 is glued to the inside of the card. For example, the paper insert may contain a greeting message in the form of printed text. As discussed above, the paper insert 56 advantageously permits the use of a dark colored card stock and enhances the overall appearance of the greeting card 40.

Many changes and modifications could be made to the invention without departing from the spirit thereof. The scope of these changes will become apparent from the appended claims.

We claim:

1. A method of manufacturing a greeting card, the method comprising the steps of:

generating an ornamental design on a computer;

outputting a digital representation of said ornamental design;

computer stitching said ornamental design on a sheet of fabric, said computer stitching step including the step of utilizing said digital representation with a computer-operating stitching machine;

folding a first sheet of card stock into a tri-fold configuration having first, second and third equal portions, one of said first and second portions being a middle portion of said first sheet of card stock;

cutting a window into said first portion;

bonding said first portion, said second portion, and said sheet of fabric together so as to form said greeting card;

displaying said ornamental design through said window cut into said first portion;

printing a message on a paper insert; and bonding said paper insert between said second and third portions.

2. The method according to claim 1, wherein said bonding step further comprises the steps of placing a sheet of web adhesive between said sheet of fabric and said second folded portion; and applying heat and pressure to said sheet of fabric, said first sheet of card stock, and said sheet of web adhesive thereby melting said sheet of web adhesive and causing said sheet of fabric to adhere to said first sheet of card stock, said applying step including the step of passing said sheet of fabric, said first sheet of card stock, and said sheet of web adhesive between a pair of opposing surfaces.

3. The method according to claim 2, wherein said pair of opposing surfaces are a pair of conveyor belts.

4. The method according to claim 2, wherein said heat is applied at a temperature in the range of 300° to 310° F., and wherein said pressure is applied in the range of 240 to 260 lbs per square inch.

5. A method of manufacturing a device for displaying an ornamental design, the method comprising the steps of:

generating said ornamental design on a computer;

outputting a digital representation of said ornamental design;

computer stitching said ornamental design on a sheet of fabric; said computer stitching step including the step of utilizing said digital output with a computer-operated stitching machine; providing a sheet of web adhesive;

providing first and second sheets of card stock;

cutting a window into said first sheet of card stock; and combining said first sheet of card stock, said sheet of fabric, said sheet of web adhesive, and said second sheet of card stock so as to form said display device, said combining step including the steps of placing said sheet of fabric beneath said first sheet of card stock, placing said sheet of web adhesive beneath said sheet of fabric, placing said second sheet of card stock beneath said sheet of web adhesive, and applying heat and pressure to said first sheet of card stock, said sheet of fabric, said sheet of web adhesive, and said second sheet of card stock thereby causing said first sheet of card stock, said sheet of fabric, and said second sheet of card stock to bond together, said applying step including the step of passing said first sheet of card stock, said sheet of fabric, said sheet of web adhesive, and said second sheet of card stock between a pair of opposing surfaces.

6. The method according to claim 5, wherein said pair of opposing surfaces are a pair of conveyor belts.

7. The method according to claim 5, wherein said digital representation is a computer program adapted for execution by said computer-operated stitching machine.

8. The method according to claim 5, wherein said heat is applied at a temperature in the range of 300° to 310° F., and wherein said pressure is applied in the range of 240 to 260 lbs per square inch.

9. The method according to claim 5, further comprising the step of folding edges of said web adhesive over edges of said sheet of fabric.

10. A product produced according to the method of claim 9.

11. A system comprising:

a first computer, said first computer cooperating with a user of said first computer so as to generate an ornamental design, and said computer defining means for outputting a digital representation of said ornamental design;

a sheet of fabric;

a second computer, said second computer being coupled to said first computer so as to permit transfer of said digital representation from said first computer to said second computer, said second computer thereby storing said digital representation;

a stitching machine, said stitching machine being coupled to said second computer and forming an output of said second computer, said stitching machine stitching said ornamental design in said sheet of fabric in response to instructions received from said second computer;

a sheet of web adhesive, said sheet of web adhesive having edges which are folded over edges of said sheet of fabric, and said sheet of web adhesive comprising a polyester polymer and having a minimum heat activation temperature of about 280° F. and a density of about 0.3 lbs per gallon;

a first section of card stock, said first section having a window cut therein;

a second section of card stock;

a bonding device including first and second opposing conveyor belts, said bonding device being adapted for receiving said sheet of fabric, said first and second sections of card stock, and said sheet of web adhesive while said sheet of web adhesive and said sheet of fabric are disposed between said first and second sections, and said bonding device applying heat at a temperature in the range of 300° to 310° F. and a temperature in the range of 240 to 260 lbs per square inch thereby melting said sheet of web adhesive and bonding said sheet of fabric to both of said first and second sections of card stock.

12. The system according to claim 11, wherein said first section and said second section are equal one-third portions of a single sheet of card stock, wherein one of said first and second sections is a middle portion of said sheet of card stock, and wherein said device forms a greeting card.

13. The system according to claim 11, wherein said first section is formed of a first sheet of card stock, and wherein said second section is formed of a second sheet of card stock.

* * * * *